US006161793A

United States Patent [19]

Lindstrand

[11] Patent Number: 6,161,793

[45] Date of Patent: Dec. 19, 2000

[54] PAPER UNWIND SPLICER FOR DRAWING FROM THE TOP OR BOTTOM OF A REEL

[76] Inventor: Bruce L. Lindstrand, 535 Danielson Dr., Darien, Wis. 53114

[21] Appl. No.: 09/235,500

[22] Filed: Jan. 22, 1999

[51] Int. Cl.[7] ..... B65H 19/18

[52] U.S. Cl. ..... 242/556; 242/556.1

[58] Field of Search ..... 242/555.3, 556, 242/556.1

[56] References Cited

U.S. PATENT DOCUMENTS

| | | | |
|---|---|---|---|
| 3,915,399 | 10/1975 | Kron et al. . | |
| 4,238,261 | 12/1980 | Tetro . | |
| 4,668,328 | 5/1987 | Kyytsönen . | |
| 4,681,274 | 7/1987 | Thievessen et al. . | |
| 4,695,004 | 9/1987 | Grossmann et al. | 242/526.3 |
| 4,705,226 | 11/1987 | Goetz | 242/556.1 |
| 4,892,263 | 1/1990 | Beisswanger . | |
| 4,936,942 | 6/1990 | Sollinger et al. . | |
| 5,288,034 | 2/1994 | Schönmeier et al. . | |
| 5,445,055 | 8/1995 | Koponen et al. . | |
| 5,487,805 | 1/1996 | Boriani et al. . | |
| 5,740,982 | 4/1998 | Kaufmann . | |
| 5,779,184 | 7/1998 | Kaufmann et al. . | |

*Primary Examiner*—John Q. Nguyen

[57] ABSTRACT

A web splicing system has a cross machine direction vacuum clamp which is brought into engagement with an unwinding web. The web is brought to a stop and vacuum is applied to the clamp holding the paper web against the clamp. A cross machine direction paper cutter such as a water jet is mounted for cross machine direction motion on the clamp. The cutter is operated to sever the web held by the vacuum clamp from the spool or remaining reel. A new reel is prepared by cutting the web in the cross machine direction to form a start or web leading edge which is parallel to the axis of the new reel. Double sided tape is applied parallel to the leading edge and closely spaced therefrom. The vacuum clamp is positionable by conventional means to bring the paper web from the previous reel to overlie the double sided tape. The vacuum box is then brought down into engagement with the new reel and the double sided tape forming a splice. If it is desired to draw paper from the bottom of the reel, the new reel is positioned in the unwinding so paper can be drawn off the bottom of the reel into the rewinder. A flap of paper approximately six to 12 inches wide either on the tail or on the start is used to connect the lower side of the tail to the inside surface of the start.

6 Claims, 3 Drawing Sheets

PAPER UNWIND SPLICER FOR DRAWING FROM THE TOP OR BOTTOM OF A REEL

BACKGROUND OF THE INVENTION

The present invention relates to apparatus and methods for splicing a paper web on a rewinder, super calendar, or coater.

After paper is manufactured on a papermaking machine, it is wound onto jumbo reels for removal from the papermaking machine. These large reels of paper of up to 400 inches in width and 180 inches in diameter and weighing more than one-hundred and seventy tons are removed from the papermaking machine and further processed to make smaller reels or individual sheets on a rewinder. Paper on a jumbo reel may be further processed through a super calendar or an off machine coater which requires unwinding the paper web from the jumbo reel. To avoid rethreading of winders, coaters, and calendars, and to avoid wasting paper, it is normal practice to splice a new reel of paper onto the end or tail of a previous reel.

Paper can be unwound from a reel off the top or off the bottom of the reel. Which side of the web faces upwardly depends on whether the roll is mounted so that the web comes off the top, or off the bottom of the roll. In the case of a jumbo reel, where the paper may have different surface finishes on opposed sides, various uses of the paper may require that one or the other side face outwardly with respect to a formed reel.

A typical example would be where sets, small reels for printing, are taken off a jumbo and where a particular grade paper or linerboard has a better side which must be positioned to enter the press uppermost.

A typical unwinder incorporates a drive system which can unwind a jumbo reel so the reel rotates in the clockwise or counter clockwise direction. If a web is drawn to the left off the top of the reel, the reel will rotate in a counter clockwise direction. For the same unwinding, if the reel is positioned so paper can be again drawn to the left but off the bottom of the reel, the reel will rotate in the clockwise direction.

Where paper is being drawn off the top of a reel, the normal procedure for changing reels is to stop the winder and the system that is receiving the web, and cut the web free from the spool. The spool is then removed from the winder drive system. A new parent reel which has been prepared by placing double sided tape along the beginning, or start of the reel is then positioned in the winder drive. Two operators lift the tail of the web from the previous reel and position it over the top of the reel where it is brought into engagement with the double sided tape to form a splice. The difficulties of forming a spice where the web is to be drawn off the bottom of a reel are such that the normal practice is to simply rethread the web into the rewinder by cutting a tail.

What is needed is a simple, speedy method and apparatus which can splice a web tail onto the web from a new parent reel so as to draw the web off either the top or the bottom of the reel.

SUMMARY OF THE INVENTION

The web splicing system of this invention employs a cross machine direction vacuum clamp which is brought into engagement with an unwinding web. The web is brought to a stop and vacuum is applied to the clamp holding the paper web against the clamp. A cross machine direction paper cutter such as a water jet is mounted for cross machine direction motion on the clamp. The cutter is operated to sever the web held by the vacuum clamp from the spool or depleted parent reel. A new reel is prepared by cutting the web in the cross machine direction to form a start, or web leading edge, which is parallel to the axis of the new reel. Double sided tape is applied parallel to the leading edge and closely spaced therefrom. The vacuum clamp is positionable by conventional means to bring the paper web from the previous reel to overlie the double sided tape. The vacuum box is then brought down into engagement with the new reel and the double sided tape forming a splice.

If it is desired to draw paper from the bottom of a reel, the new parent reel is positioned in the unwinder so paper can be drawn off the bottom of the reel into the rewinder. The reel in this case is prepared by folding back a flap of paper approximately six to twelve inches wide and applying double sided tape to the underside of the web which has been positioned facing upwardly by the folding back of the flap. The flap is positioned in the same place on top of the reel as the leading edge is positioned when a spice for drawing paper off the top of the reel is to be formed. Again the vacuum clamp is used to position and attach the web from the previous reel to the double sided tape. However, when the web is now drawn into the rewinder the web will fall off the top and begin pulling from the bottom of the reel.

Another embodiment employs a two-chambered vacuum clamp. The chambers are positioned parallel to one another and extend in the cross machine direction and are positioned downstream of the web cutter. A vacuum is drawn on both chambers to hold the web while the web is cut. The web can be drawn from the top or from the bottom of the next reel. If the web is to be drawn from the top, the two-chambered vacuum box is operated similarly to the single chambered vacuum clamp. If the web is to be drawn from the bottom of the new reel, after the web is cut the vacuum chamber closest to the cut is pressurized by injecting air so that a portion of the web is released and hangs down forming a flap. This flap is bent against the clamped portion of the web by air jets. The reel is positioned to draw the web off of the bottom of the new reel, while the flap formed at the tail of the previous reel web held by the two-chambered clamp allows the tail of a depleted reel to be brought into engagement with tape positioned along the start of the new parent reel to form a splice for drawing paper off the bottom of the web.

It is a feature of the present invention to provide an apparatus for splicing a web to a new parent reel so that paper can be drawn off the top or the bottom of the reel.

It is a further feature of the present invention to reduce the time it takes to load and splice a new reel to a web of paper in a winder.

It is another feature of the present invention to reduce the labor and number of personnel required to change parent reels.

It is a still further feature of the present invention to provide a method whereby a new parent reel can be spliced at the same position when the web is drawn off the top or the bottom of the reel.

Further objects, features and advantages of the invention will be apparent from the following detailed description when taken in conjunction with the accompanying drawings.

DESCRIPTION OF THE PREFERRED EMBODIMENTS

Figure 1:
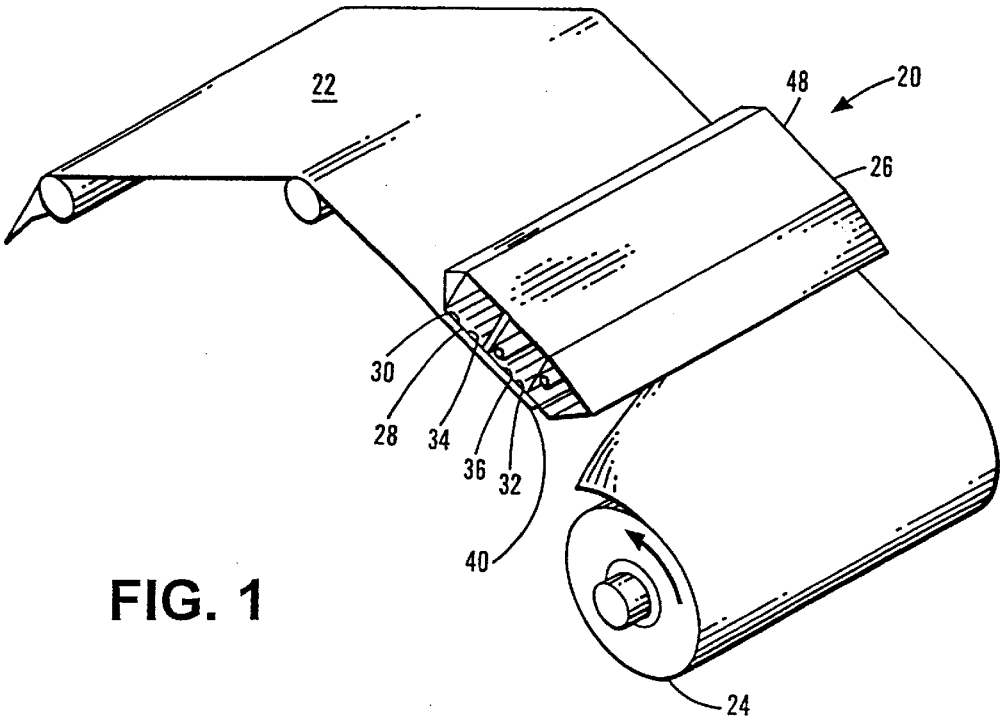
FIG. 1 is an isometric view of a cross machine direction vacuum clamp and web cutting apparatus engaged with a paper web which is being cut off the end of a reel.
Figure 2:
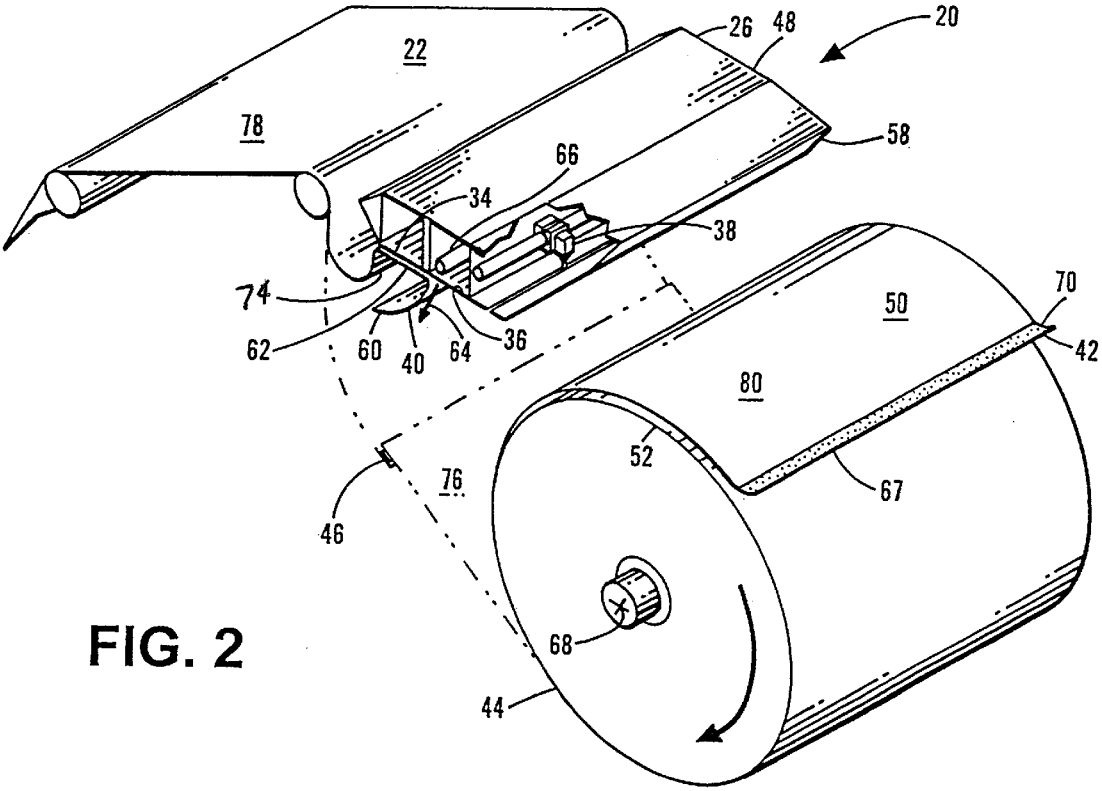
FIG. 2 is an isometric view of the vacuum clamp and web cutting apparatus of FIG. 1 showing how the cut web is positioned to be spliced with a new parent reel and with the sliced web being drawn off the parent reel shown in phantom.

Referring more particularly to FIGS. 1–6*c* wherein like numbers refer to similar parts, a web splicing apparatus 20 is shown in FIGS. 1–2. The apparatus 20 is part of a entire machine which includes a unwinding stand (not shown) which includes a drive for positioning and unwinding a parent reel. The entire machine will typically includes the components which make up a winder, rewinder or coaters.

In FIG. 1 a paper web 22 which extends to a winder, calendar, or rewinder (not shown) is supplied from a parent reel 24 which is substantially depleted. As illustrated in FIG. 1, the depleted parent reel 24 has been stopped and a cross machine direction beam 26 which extends the full width of the web 22 is positioned to overlie the web 22.

The web 22 is clamped to the underside 28 of the beam 26 by a first cross machine direction vacuum box 30 and a second cross machine direction vacuum box 32 which is parallel to and adjacent to the first vacuum box 30. Air is drawn through the underside 28 of the beam 26 through a first foraminous bottom panel 34, and through a second foraminous bottom panel 36 clamping the web 22 to the underside 28 of the beam 26.

A water knife 38 consisting of a jet of high pressure water which may have a pressure of upwards of 60,000 psi is directed downwardly through the web 22 and is mounted on the beam 26 to be traversed across the web 22 as shown in FIGS. 1 and 2. The severed web 22 forms a tail 40 which must be connected to a start 42 on a new parent reel 44 in order to form a splice 46 as illustrated in FIG. 2.

A cross machine direction vacuum clamp and web cutting apparatus 48 formed by the beam 26, the vacuum boxes 30, 32, and the water knife 38 facilitates attaching the tail 40 of the depleted web 22 to the start 42 of the new parent reel 44 so that the web 50 wound on the new parent reel 44 can be drawn off the bottom as illustrated in FIGS. 3*a* through 3*d* and in FIG. 2. Alternatively, the web 50 can be drawn off the top as illustrated in FIGS. 4*a* through 4*c* and FIG. 1.

The forming of the splice 46 between the tail 40 and the start 42 of the new parent reel 44 is always accomplished by bringing the apparatus 48 with the attached web 22 into engagement with the new parent reel 44 at approximately the top 52 of the reel 44. Thus the cross machine direction vacuum clamp and web cutting apparatus 48 is mounted for motion by conventional means (not shown), such as hydraulic, pneumatic or mechanical linkages to move between a position (not shown) spaced from the unwinding web 22 into engagement with the non-moving web 22 as shown in FIG. 1 and to overlie and engage the top 52 of the new parent reel 44.

Positioning of the apparatus 48 over the top 52 of the reel 44 allows uniform pressure to be developed assuring a good bond between the tail 40 and the start 42. The same apparatus 48 can be used to form a splice automatically with a new parent reel so that the web can be drawn off either the top or the bottom of the reel 44. The apparatus 48 is also advantageous because it is easily retrofitted into existing installations, as the apparatus only interacts with the web of the depleted reel 24 or with the top of the newly prepared parent reel 44. Thus its dependence on the design of the unwinding drive and the apparatus to which the web is being fed—namely a winder, rewinder, or coater—is minimal, except that the unwinding stand drive (not shown) must coordinate the positioning of the tape 70 with the apparatus 48 to affect the splice 46. This minimal modification to the unwinding stand (not shown) could be as simple has a electric eye which can detect the tape 70 and thus coordinate reel movements with the apparatus 48.

Figure 3A:
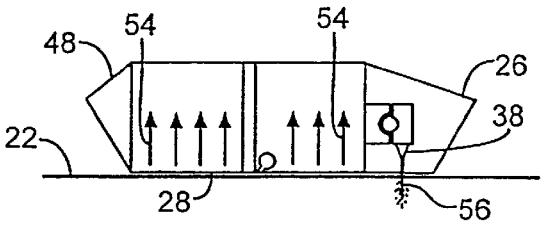
FIGS. 3*a*–3*d* show the steps whereby the vacuum clamp and web cutting apparatus of FIG. 1 is used to cut a web and position the top side of the web to be bonded to the outer side of a new parent reel so paper can be drawn off the bottom of the new parent reel.

Referring to FIGS. 3*a*–3*d*, a process whereby the apparatus 48 is used to form a splice 46 for drawing the web 50 off the bottom of a new parent reel 44 is illustrated. The apparatus 48 is positioned over the web 22 as shown in FIGS. 3*a*, and a vacuum indicated by arrows 54 draws the web 22 tight against the underside 28 of the beam 26. The jet 56 of the water knife 38 penetrates the web 22 and severes the web from the depleted reel 24 as it is traversed across the reel-facing side 58 of the apparatus 48 by a drive system such as a double-acting pneumatic piston, as shown in FIG. 2.

Figure 3B:
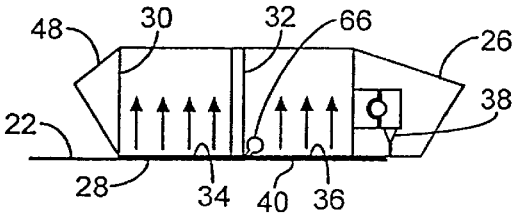

FIG. 3*b* shows the tail 40 clamped to the underside 28 of the beam 26. With the tail 40 thus clamped, the apparatus 48 can be moved into a position as illustrated in FIG. 2 which allows removal of the depleted parent reel 24 from an unwinding drive (not shown) and the installation of a new parent reel 44 in the same drive.

Figure 3C:
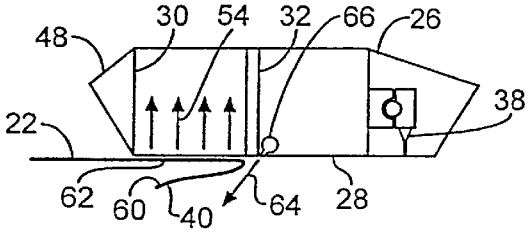

FIG. 3*c* illustrates releasing a portion of the web 22 to form a flap 60 which is folded back over a portion 62 of the web 22 which remains clamped. The folding back may be accomplished with air jets 64 which are flush with the underside 28 and extend from a compressed air manifold 66.

Figure 3D:
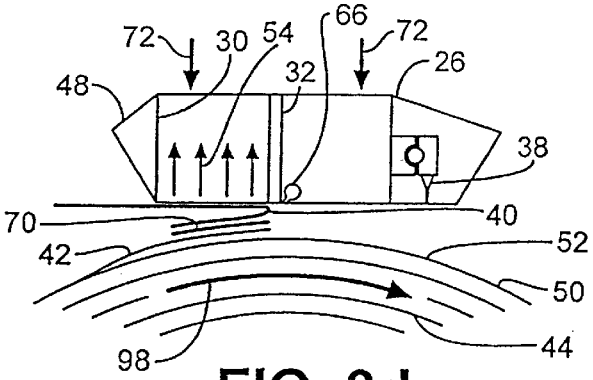

FIG. 3*d* shows the top 52 of the new parent reel 44 which is also illustrated in FIG. 2. A start 42 defined by the web leading edge 67 is formed by cutting the web 50 parallel to the axis 68 of the reel 44. Double sided sticky tape 70 is applied parallel to the web leading edge 67 before the parent reel 44 is loaded into the unwind and positioned with the unwinding drive (not shown). Positioning of the tape 70 will preferably be accomplished by rotating the reel 44 and tape 70 towards the fold defining the flap 60. Thus in FIG. 3*d* the tape 70 is positioned by moving to the left opposite the direction indicated by arrow 98. The beam 26 of the apparatus 48 is then moved as indicated by arrows 72 downwardly toward the top 52 of the reel 44 to press the underside of the flap 60 against the tape 70 to form the splice 46. In order to form a strong splice which will smoothly pass through equipment downstream of the reel 44, it is necessary that the tail 40 and the start 42 overlap. A glue or tape bond is strong in shear but if the tail and start abut such that they could be peeled apart under tension, a poor splice would result.

For an overlapping splice to be formed the bottom surface 74 of the web 22 from the depleted reel must engage the surface 76 of the new reel which will be uppermost as the web 50 is being drawn from the new parent reel 44. Or the top surface 78 of the web 22 must engage the surface 80 which will be lower most as the web is being drawn from the new parent reel. Whether the web 50 is drawn off the top or the bottom of the reel 44 controls which surface of the web 50 will be uppermost. It follows then that the apparatus 48 functions to allow the tail to be bonded to the start with either the top side or the bottom side engaging the double sided tape 70 depending on whether the web 50 is drawn from the top or from the bottom of the reel 44.

Figure 4A:
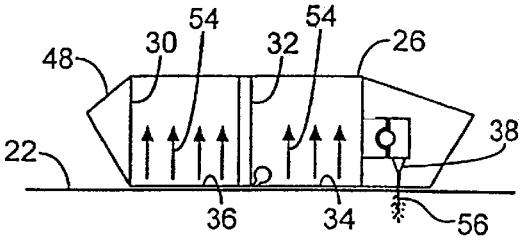
FIGS. 4*a*–4*c* show the steps whereby the vacuum clamp and web cutting apparatus of FIG. 1 is used to cut a web and position the bottom side of the web to be bonded to the outer side of a new parent reel so paper can be drawn off the top of the new parent reel.
Figure 4B:
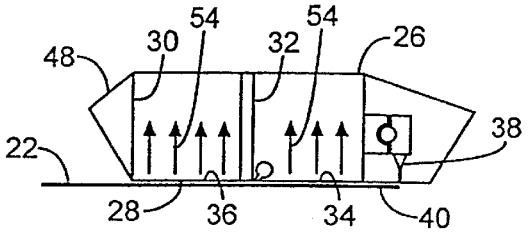
Figure 4C:
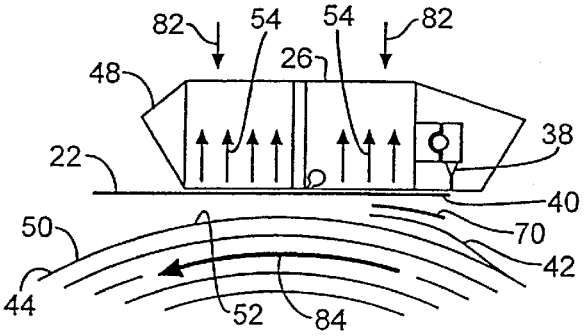

Thus FIGS. 4*a* through 4*c* show the apparatus 48 being used to form a splice for drawing the wound web 50 off the top of the cross machine direction beam 26 is positioned in FIG. 4*a* to clamp the web 22 while the water knife 38 cuts the web 22 free from the depleted reel 24. The tail 40 as held by the vacuum boxes 30, 32 is then positioned over the top 52 of the new parent reel 44 and is moved downwardly as indicated by arrows 82, pressing the tail 40 of the web 22 into an engagement with the start 42 and the double sided tape 70 is which is positioned along the start 42. The reel 44, shown in FIG. 4*c*, rotatates to the left, as indicated by arrow 84.

An alternative embodiment cross machine direction vacuum clamp and web cutting apparatus 86 is shown in FIGS. 5*a* through 6*c*. The apparatus 86 has a cross machine direction beam 88, a single cross machine direction extending vacuum box 90, and a water knife 92 mounted for motion across a web 22 on the beam 88.

Figure 5A:
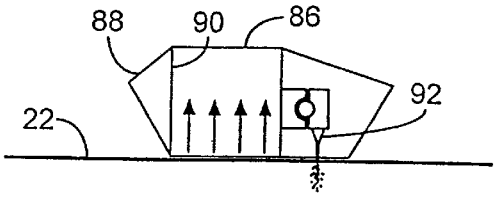
FIGS. 5*a*–5*c* show the steps whereby an alternative embodiment cross machine direction vacuum clamp and web cutting apparatus is used to cut a web and position the bottom side of the web to be bonded to the inside side of a new parent reel so paper can be drawn off the bottom of the new parent reel.
Figure 5B:
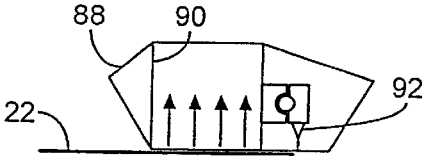
Figure 5C:
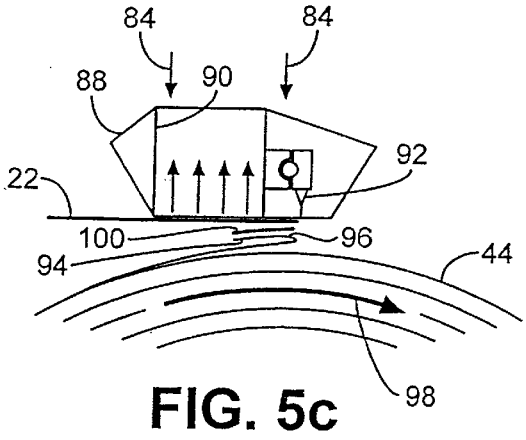

FIGS. 5*a* through 5*c* show how the simplified apparatus 86 can cooperate with the flap 94 formed by folding back a portion of the web 50 on the new parent reel 44 to expose the underside 96 of the web 50. Double sided tape 70 is placed on the exposed underside 96 and bonds to the bottom surface 74 the web 22. FIG. 5*c* shows the web 50 being drawn off the bottom of the reel as indicated by arrow 98. The splice 100 is similar to the splice 46 shown in FIGS. 3*d* and 2 except that the flap 94 is formed on the wound web 50 and the surface 96 which will be uppermost when the web is unwound underlies and is bonded to the underside surface 74 of the web 22.

Figure 6A:
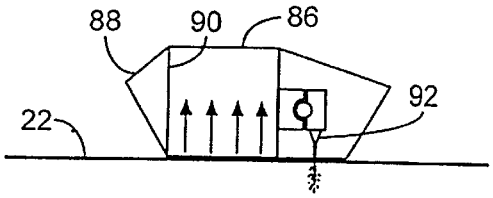
FIGS. 6*a*–6*c* show the steps whereby the alternative embodiment cross machine direction vacuum clamp and web cutting apparatus is used to cut a web and position the bottom side of the web to be bonded to the outer side of a new parent reel so paper can be drawn off the top of the new parent reel.
Figure 6B:
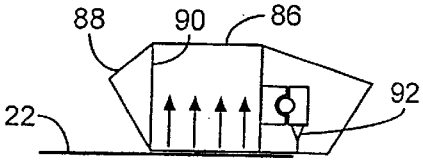
Figure 6C:
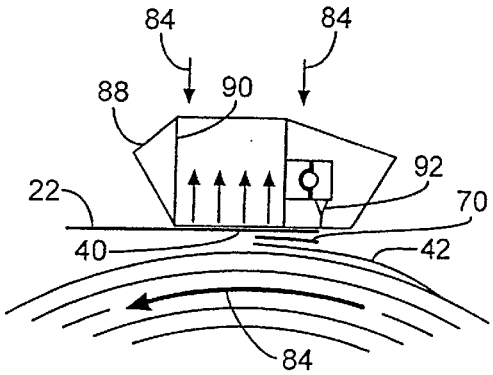

The operation of the apparatus 86 in FIGS. 6*a* through 6*c* is identical to that shown and described with respect to FIGS. 4*a* through 4*c*.

It should be understood that wherein a water knife is shown for cutting the web 22, other means for cutting the web including but not limited to a knife, a rotating saw blade, or laser may be employed.

It should also be understood that wherein a pneumatic piston arrangement is shown for moving the water knife, or other cutting means, motion of the cutting means could be accomplished with various mechanisms for generating linear motion including but not limited to a timing belt, a hydraulic piston, and a spline and gear arrangement.

Where an air jet is described and illustrated for forming a flap on the tail of the web 22, the air jet could be located in various locations other than that illustrated, including between the vacuum boxes 30, 32. In addition, other means for folding the flap including gravity alone, could be used.

Double sided sticky tape is typically used for forming a splice in a parent reel. However, various spray-on glues, adhesives, or hot melt glues can be used.

The speed with which a splice is made between the tail of the previous reel and a new parent reel is critical with a desirable goal being within one to three minutes. Known web cutters can cut a 400-inch web in approximately one to two seconds. Such speeds are perhaps best accomplished with a pneumatic drive on the web cutting means.

It will be understood by those skilled in the art that the new start on the parent reel will be temporary held in place by non-aggressive tape in a few places which easily pulls away when the splice is formed. Further the parent reel drive and the take up system for the winder, rewinder, or calendar are designed to detect tension in the web and to begin winding slowing until any slack in the web is taken up.

It should also be understood that in FIGS. 4*c*, 5*c* and 6*c* where the apparatus 48 and apparatus are shown positioning the tail 40 with little or no overlap with the start 42 some overlap could be used to allow the portion of the tail 40 which is clamped by one or more vacuum boxes 30,32, 90 to engage the tape 70.

It is understood that the invention is not limited to the particular construction and arrangement of parts herein illustrated and described, but embraces such modified forms thereof as come within the scope of the following claims.

What is claimed is:

1. An apparatus for splicing a depleting web to a parent reel comprising: a web leading to a splitter, calendar, or rewinder, the web having an upper side and a lower side;

a parent reel wherein the web extends from the splitter, calendar, or rewinder toward the parent reel, the reel being formed of a wound web;

a positionable cross machine direction beam having a first vacuum box which extends in the cross machine direction and which opens downwardly, and a second vacuum box which extends in the cross machine direction and which opens downwardly and which is adjacent to and parallel with the first vacuum box, the beam having a side toward the reel and a side away from the reel and toward the splitter, calendar, or rewinder;

a means for cutting the depleting web mounted to the beam for movement in the cross machine direction to completely traverse the width of the web, the means for cutting being mounted between the second vacuum box and the reel side of the beam;

a means for folding the depleting web mounted to the beam and parallel to the beam, the means for folding being mounted to the beam between the first vacuum box and the second vacuum box, wherein the depleting web is clamped to at least the first vacuum box, and wherein the parent reel has a start and a means for bonding positioned on the parent web parallel to the start, and wherein the start is positioned substantially uppermost on the reel, and wherein the beam is positionable to bring the cut web clamped to the first vacuum box into engagement with the means for bonding on the parent web at a position substantially uppermost on the reel.

2. The apparatus of claim 1 wherein the web is clamped to the first and second vacuum box.

3. The apparatus of claim 1 wherein a flap of cut web sufficient to extend between the first vacuum box and the means for cutting the web is folded under the portion of the cut web which is clamped to the first vacuum box, thus positioning a portion of the upper side of the web facing downwardly, and wherein the parent reel is positioned so as to allow the wound web to be pulled off the bottom of the reel toward the web leading toward the winder, calendar or rewinder.

4. The apparatus of claim 1 wherein the start on the parent reel is folded back to form a flap exposing outwardly a portion of web surface which in the unwound condition would face inwardly, the means for bonding positioned on the parent web parallel to the start and on the flap, wherein the start is positioned substantially uppermost on the reel, and wherein the beam is positionable to bring the web clamped to the first vacuum box into engagement with the means for bonding on the parent web at a position substantially uppermost on the reel, and wherein the parent reel is positioned so as to allow the wound web to be pulled off the bottom toward the web leading toward the winder, calendar or rewinder.

5. The apparatus of claim 1 wherein the means for folding the web is one or more air jets.

6. The apparatus of claim 1 wherein the means for cutting the web is a water jet mounted for movement in the cross machine direction.

* * * * *